United States Patent [19]

Calvet

[11] 4,131,399

[45] Dec. 26, 1978

[54] PERISTALTIC TUBE PUMP WITH MEANS PREVENTING COMPLETE OCCLUSION OF TUBE

[75] Inventor: Gérard Calvet, Ivry-sur-Seine, France

[73] Assignee: Rhone-Poulenc Industries, Paris, France

[21] Appl. No.: 702,205

[22] Filed: Jul. 2, 1976

[30] Foreign Application Priority Data

Jul. 8, 1975 [FR] France ..... 75 21360

[51] Int. Cl.[2] ..... F04B 43/08; F04B 43/12; F04B 45/06

[52] U.S. Cl. ..... 417/477; 138/118

[58] Field of Search ..... 417/477, 476, 475, 474; 138/DIG. 11, 110, 119, 118; 251/6; 128/214 F, DIG. 3

[56] References Cited

U.S. PATENT DOCUMENTS

| | | | |
|---|---|---|---|
| 460,944 | 10/1891 | Burson | 417/477 |
| 2,693,766 | 11/1954 | Seyler | 417/477 |
| 2,854,028 | 9/1958 | Ballard et al. | 251/6 |
| 3,056,428 | 10/1962 | Brown et al. | 138/118 |
| 3,128,716 | 4/1964 | Stallman et al. | 417/474 |
| 3,192,863 | 7/1965 | Vadot | 417/477 |
| 3,508,587 | 4/1970 | Mauch | 52/108 |
| 3,685,787 | 8/1972 | Adelberg | 251/6 |
| 3,784,323 | 1/1974 | Sausse | 417/477 |
| 4,029,441 | 6/1977 | Fischer | 417/477 |

FOREIGN PATENT DOCUMENTS

| | | | |
|---|---|---|---|
| 395239 | 7/1933 | United Kingdom | 138/119 |
| 447816 | 5/1936 | United Kingdom | 138/118 |

*Primary Examiner*—Carlton R. Croyle
*Assistant Examiner*—Thomas I. Ross
*Attorney, Agent, or Firm*—Gerald D. Sharkin; Robert S. Honor; Walter F. Jewell

[57] ABSTRACT

A peristaltic pump equipped with at least one peristaltic tube is disclosed characterized in that the said tube is associated with means which limit its occlusion, independently of the physical and/or mechanical stresses to which it may be subjected. The peristaltic tube is provided with at least one longitudinal groove or ridge on the internal surface of its wall. Alternatively, a strand may extend longitudinally inside the peristaltic tube, at least over the part subjected to the action of the pressing devices, and this strand is rigid or semi-rigid and has the shape of an arc of a circle. The strand may be flexible and may be firmly attached to the peristaltic tube at least at a point located upstream from the pressing devices. Various other geometrical arrangements are disclosed. The peristaltic pump is especially adapted to extracorporal blood circulation. The peristaltic tube is of such dimensions that when flattened transversely, there remains at least one passage, the ratio of the cross-section of the passage to the cross-section of the channel of the tube at rest being between 1/10 and 1/10,000. The peristaltic tube consists of a silicone elastomer and may be coated on the internal surface and/or the external surface with a thin layer of a silicone elastomer.

13 Claims, 26 Drawing Figures

PERISTALTIC TUBE PUMP WITH MEANS PREVENTING COMPLETE OCCLUSION OF TUBE

THE INVENTION

The present invention relates to an improvement in peristaltic pumps. The advantageous characteristics of these pumps cause them to be used widely, especially in the medical field. It also relates to the application of these pumps and to the peristaltic tubes in themselves.

The peristaltic pump described in U.S. Pat. No. 3,784,323 exhibits a tube which is only partially flattened by the pressing devices, and thus a passage is preserved. In an extracorporal blood circuit, this pump thus makes it possible to move the blood and at the same time to hold back bubbles of air which could accidentally be introduced into the blood. In order to regulate the passage cross-section, at the pressing devices, to a value which permits the return of the air, it suffices to adjust the tension of the tube, a higher tension making it possible to reduce the passage cross-section, and vice versa. A pump of this type is thus very convenient to use.

However, the pumps of this type must, from the point of view of safety, conform to at least two contradictory conditions. In fact, they must on the one hand automatically limit the delivery pressure and, on the other hand, reduce their delivery rate in accordance with the increasing amounts of air retained. Now, in general, a peristaltic tube of defined characteristics (especially as regards the thickness and the hardness of the elastomer of which it is made), and a defined pump speed, which depends on the admissible degree of haemolysis, are used.

If the pressure drops in the circuit are higher than intended, the only thing possible under these conditions is to increase the maximum delivery pressure of the pump. For this, it is necessary to increase the tension of the peristaltic tube, which reduces the passage cross-section at the pressing devices. This thus brakes the return of the air, in counter-current, at the pressing devices, which entails the risk of causing bubbles of air to be entrained in the blood which returns to the patient.

This risk is the more real, the higher are the pressure drops in the extra-corporal circuit on the pump delivery side, thus making it necessary to maintain a higher tension of the peristaltic tube.

Conversely, the improvement in the retention of the air can be achieved by reducing either the speed of the pump or the tension of the peristaltic tube. In both cases, the delivery pressure is reduced and it may be necessary to reduce it to values below those desired.

It has thus been found that the pumps according to the prior art make it necessary, both as regards their manufacture and their use, to make compromises in an attempt to satisfy these two contradictory conditions, from the point of view of safety.

The present invention proposes a peristaltic pump which does not suffer from the disadvantages of the prior art, and which in particular does not impose such a compromise.

It also proposes a peristaltic pump capable of moving a liquid and retaining a gas, regardless of the axial tension exerted on the tube, the pressure exerted on the latter by rollers or fingers and/or the drive speed of the rollers, or the pressure exerted by the stator on the tube.

The invention proposes to improve the safety of operation of extra-corporal blood circuits which comprise peristaltic pumps but are devoid of specific bubble detectors, which is generally the case with circuits used, for example, with artificial kidneys.

There has now been found, and it is this which forms the subject of the present invention, a peristaltic pump equipped with at least one peristaltic tube, characterized in that the said tube is associated with means which limit its occlusion, independently of the physical and/or mechanical stresses to which it may be subjected.

The peristaltic pumps according to this invention can be such that the means which are associated with the peristaltic tube and limit its occlusion are located on the internal surface or located on the external surface of the wall of the peristaltic tube.

Thus the peristaltic tube can be equipped, for example, on the internal surface of its wall with at least one longitudinal groove or at least one longitudinal ridge. It can also be equipped, for example, on the external surface of its wall, with at least one longitudinal ridge or at least one longitudinal boss.

By "internal surface" of the wall of the peristaltic tube there is to be understood, in the text which follows, the surface which internally limits the wall and which is in contact with the fluid conveyed by the peristaltic pump.

By "external surface" of the wall of the peristaltic tube there is to be understood, in the text which follows, an actual and/or imaginary surface which externally limits a wall of constant thickness equal to the minimum thickness of the wall of the said tube; this external actual and/or imaginary surface is not in contact with the conveyed fluid. In the attached figures, an imaginary external surface will be represented in broken lines.

"Occlusion" is to be understood as the complete closing of a channel. The pump according to the invention is equipped with means which limit the occlusion of the peristaltic tube, that is to say with means which limit the closing of the tube when the latter is flattened by the pressing devices, regardless of the longitudinal tension of the tube and/or the pressure exerted on the latter by pressing devices, such as, for example, rollers or fingers, or the pressure exerted by the stator on the tube.

For this reason, a passage remains at the pressing devices and it is this passage which allows the air to return in counter-current.

Thus, the pumps according to the present invention are never occlusive, regardless of the physical and/or mechanical stresses to which the peristaltic pumps may be subjected. The minimum passage cross-section is defined so as, firstly, to allow the air to return but also, secondly, so as to resist any significant reverse flow of liquid when the pump is in operation. The ratio of the passage cross-section to the cross-section of the channel of the peristaltic tube when at rest is generally between 1/10 and 1/10,000 and preferably between 1/20 and 1/1,000. This ratio is determined by those skilled in the art, for example determined experimentally, taking into account the various conditions of use and especially the flow rate of the fluid conveyed. This ratio is the higher, the higher is the viscosity of the liquid.

The present invention will be better understood with the aid of the attached figures which illustrate various embodiments of the peristaltic tube with which the peristaltic pumps according to the invention are equipped. These various embodiments are given by way of example and do not imply any limitation; they are not shown on any defined scale.

The various embodiments of peristaltic tubes with which the peristaltic pumps according to the present invention are equipped, and which will be described below, can be produced in various materials which are both supple and elastic, and may or may not be opaque. For peristaltic pumps used in the medical field, the peristaltic tubes can optionally be provided on their internal surface, and optionally on their external surface, with a coating of a material which is compatible with the biological liquids which may flow inside the tube. They can in particular be coated with a thin layer of a silicone elastomer, especially according to the technique described in the French Patent published under No. 2,126,573.

To produce peristaltic tubes, natural or synthetic rubbers, polyvinyl chloride or polyurethane may be used; however, it is preferred to use silicone elastomers which are at one and the same time supple, elastic, fluid-tight, and biocompatible.

The peristaltic pumps according to this invention, provided with peristaltic tubes such that the means which limit their occlusion are located on the internal surface of the wall of the tube, are described first. FIGS. 1 to 8 more specifically illustrate various embodiments of such peristaltic tubes.

Figure 1:
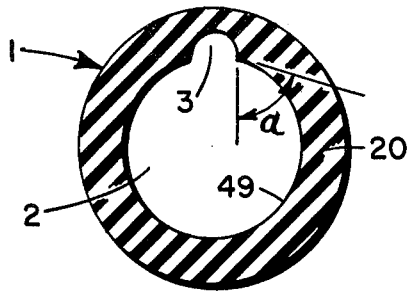
FIG. 1 is a cross-sectional view of a first embodiment of a peristaltic tube, at rest.

Referring to FIG. 1, it is seen that the peristaltic tube 1, made of an elastic material, for example, a silicone elastomer, defines, at rest, a cylindrical channel 2, for example of substantially circular cross-section. The external profile of the cross-section of the tube 1, though generally circular when at rest, is not critical. According to the invention, a longitudinal groove 3 of substantially constant cross-section, for example of semicircular shape, is located on the internal surface 49 and is accommodated in the thickness of the wall 20 of the peristaltic tube 1 and communicates amply with the channel 2.

Figure 2:
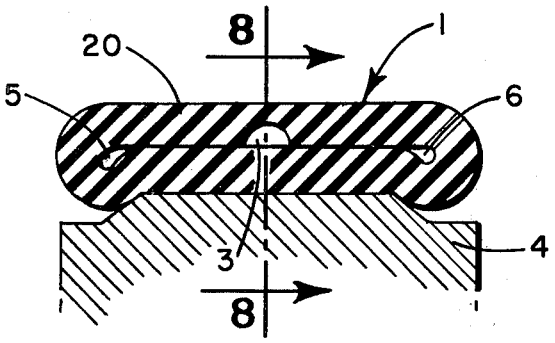
FIG. 2 is a cross-sectional view of the tube according to FIG. 1, flattened against a roller.

Periodically, one of the fingers or the rollers 4 of the pump gradually flattens the peristaltic tube which, in cross-section, then assumes the appearance shown in FIG. 2. Since the tube is elastic, it subsequently tends to resume the shape which it had at rest.

On the peristaltic pumps of known types, and on the pumps according to the present invention, as long as the flattening of the tube is partial, the cross-section of the channel 2 generally assumes the profile of a dumb-bell, swollen at the two ends and thin in the center. However, on the pumps of known types, when the flattening of the tube against the roller reaches its maximum value, the passage cross-section of the channel 2 is reduced to that of the much smaller channels 5 and 6. This residual passage cross-section is generally very small or even practically zero, but it varies especially in accordance with the tension of the peristaltic tube, and an increase in the tension can render the pump occlusive.

In contrast, however, on the pump according to the present invention the groove 3 remains fully open, regardless of the degree of flattening of the peristaltic tube, that is to say regardless of the longitudinal tension of the tube and/or the pressure of the roller or of the stator on the tube. Thus, the pump according to the present invention is never occlusive, regardless of the physical and/or mechanical stresses to which the peristaltic tube may be subjected.

Figure 8:
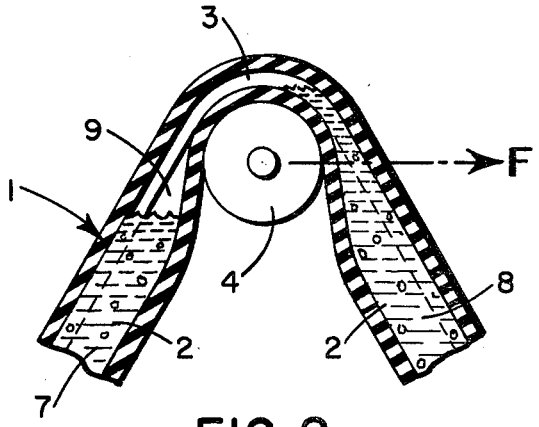
FIG. 8 is a view in longitudinal section, taken along line 8—8 of FIG. 2.

The operation of the pump according to the present invention appears even more clearly on reference to FIG. 8. Only the upper part of the pump, corresponding to a length of tube between the intake and delivery orifices, has been shown; the peristaltic tube essentially occupies the position of an inverted U. The roller 4 travels firstly along or in the direction of the arrow F whilst turning about the axis of rotation of the pump and secondly whilst turning about itself, practically without friction in contact with the peristaltic tube.

The liquid is thus displaced or moved from upstream 7 to downstream 8 in the peristaltic tube. However, the air contained in this liquid remains in the zone 9, in the upper part of the pump, inside the peristaltic tube. The bubbles of air which are carried downstream can reach the zone 9 through the groove 3.

It is thus possible to retain the air trapped in the peristaltic pump independently of (a) the tension exerted, (b) the pressure exerted by the fingers or rollers on the peristaltic tube, or (c) the speed of travel of the latter. It is thus possible to regulate, completely safely, the delivery pressure and the flow rate of the pump to any desired values.

The shape of the cross-section of the groove is critical. The width and the depth of the groove are generally so chosen that the width is between one-third and five times the depth. Preferably, the width of the groove is between the depth of the groove and three times this value. The walls of the groove generally form a secant to the internal surface 49 of the wall 20 of the channel 2 of the peristaltic tube, and it is advantageous if the intersection of the secant and the internal surface makes an angle $\alpha$ which is between 45° and 90° (FIG. 1).

Furthermore, it is important that the groove 3 should communicate amply with the channel 2 of the peristaltic tube, over a width which is generally greater than half the maximum width of the groove.

Furthermore, for reasons of manufacture, the groove advantageously extends over the entire length of the peristaltic tube, but in certain cases it may extend only over the part of the peristaltic tube which is subjected to the action of the fingers or rollers of the pump.

In order to have available a passage of sufficient cross-section, it may be advantageous in certain cases to divide the groove 3 into several similar grooves. Thus it is possible to have, for example, up to five substantially parallel longitudinal grooves, without this number implying a limitation.

These grooves are advantageously distributed over the part of the wall of the peristaltic tube which is not in contact with the fingers or rollers.

The profile of the fingers or rollers is generally not critical; it is possible to use mechanical devices of any known type.

Figure 3:
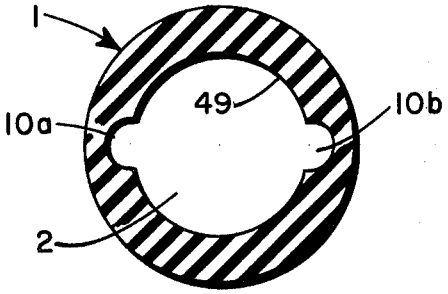
FIG. 3 is a cross-sectional view of a second embodiment of a peristaltic tube, at rest.
Figure 4:
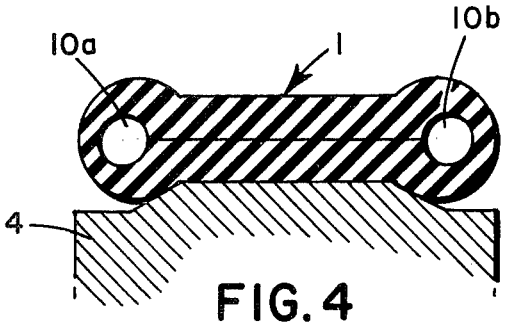
FIG. 4 is a cross-sectional view of the tube according to FIG. 3, flattened against a roller.

FIG. 3 represents a second embodiment of the peristaltic tube. This peristaltic tube is provided with two parallel grooves 10*a* and 10*b* identical with one another and also with the above groove 3. They are in diametrically opposite positions and the peristaltic tube is advantageously folded along these grooves, as is shown in FIG. 4. Since the wall of the peristaltic tube is thinner at the fold, lower stresses, less wear and a longer working life result thereby. If desired, it is also possible to fold the tube in such a way that the two grooves are located opposite one another.

Of course, the arrangements shown in FIGS. 2 and 4 can be combined with 3 or more grooves.

Figure 5:
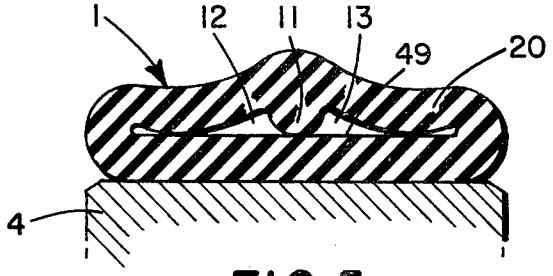
FIG. 5 is a cross-sectional view of a third embodiment of the peristaltic tube, flattened against a roller.

A third embodiment of the peristaltic tube is shown in FIG. 5. The peristaltic tube 1 is no longer equipped with a longitudinal groove but instead with a longitudinal ridge 11. This ridge 11, on resting against the opposite internal surface 49 of the peristaltic tube, creates, on either side of it, two passages 12 and 13 equivalent to the passage created by the groove 3 of the peristaltic tube shown in FIGS. 1 and 2.

Figure 6:
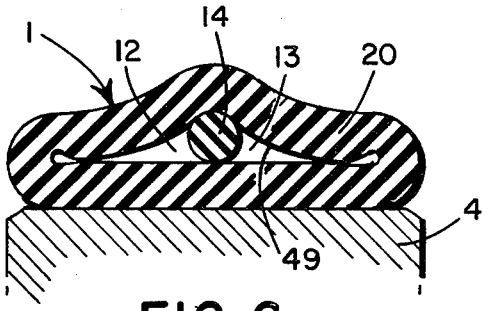
FIG. 6 is a cross-sectional view of a fourth embodiment of the peristaltic tube, flattened against a roller.

A fourth embodiment of a peristaltic tube for pumps according to the present invention is shown in FIG. 6. At least one strand, for example a flexible strand, and, for example, of circular cross-section 14, is located inside the peristaltic tube. It advantageously consists of the same material as the tube and is firmly fixed to the latter at least at one point, at the upstream end, and preferably at both ends, by any known means, for example by heat-sealing.

In a case where the peristaltic tube is prone to be stretched, the strand is advantageously a little longer than the tube between its points of attachment, so that its cross-section is virtually not reduced when the tube is stretched.

As in the preceding embodiment, the strand produces two longitudinal passages 12 and 13, equivalent to the passage created by the groove 3. This embodiment makes it possible to use standard tubes.

A variant of this embodiment consists of introducing into a peristaltic tube, over a part of its length, a rigid or semirigid strand in the form of an arc of a circle, generally a semicircle of which the diameter makes it possible to envelop the pressing devices of the peristaltic pump, of the rotary type, for which it is intended. The particular shape of the strand allows it to remain in position on the peristaltic pump without it being necessary to join the strand firmly to the peristaltic tube.

Figure 7:
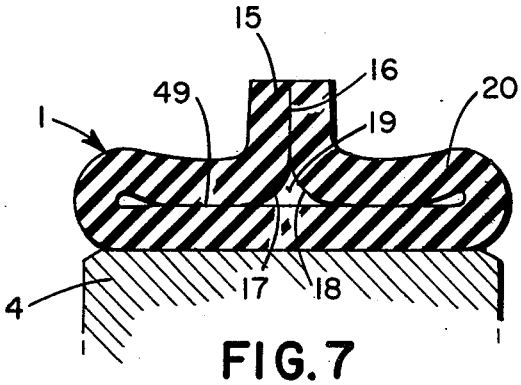
FIG. 7 is a cross-sectional view of a fifth embodiment of a peristaltic tube, flattened against a roller.

In certain peristaltic pumps it can be advantageous to hold the tube within a fixed seat, usually called a stator. For this purpose, the peristaltic tube is provided externally with a guide ridge 15 which engages in a corresponding seat provided in the stator. According to the invention, and as shown in FIG. 7, it is thus possible to use a tube consisting, for example, of a sheet of elastomer of which the two longitudinal edges are folded face to face and sealed at 16. The opposite rounded edges 17 and 18 define, on the internal surface 49 of the tube 1, a groove of substantially triangular cross-section which creates a longitudinal passage 19 when the peristaltic tube is flattened.

Peristaltic pumps according to the present invention, but provided with peristaltic tubes on which the means which limit their occlusion are located on the external surface of the wall of the peristaltic tube, are now described below. FIGS. 9 to 20, which are attached, more specifically illustrate various embodiments of such peristaltic tubes.

Figure 9:
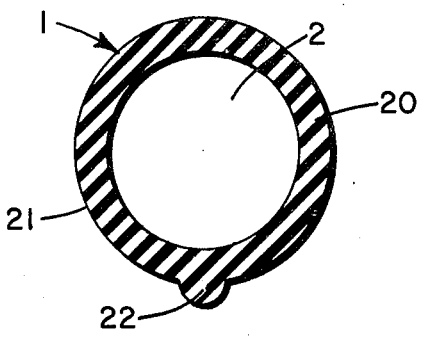
FIG. 9 is a cross-sectional view of a sixth embodiment of a peristaltic tube, at rest.
Figure 13:
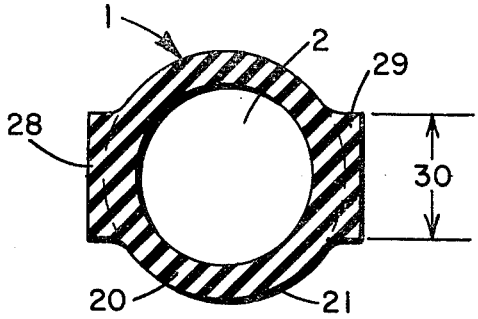
FIG. 13 is a cross-sectional view of an eighth embodiment of a peristaltic tube, at rest.

The peristaltic tube 1 according to the embodiment shown, at rest, in FIG. 9 defines a channel 2 which, in cross-section, is in this case of substantially circular cross-section. The tube has a wall 20 of substantially constant thickness, and the external profile of the cross-section of the tube 1 at rest is thus also substantially circular.

The peristaltic tube 1 according to the present invention carries, on its external surface 21, a longitudinal ridge 22, generally along a generatrix of the tube, which ridge is of substantially constant cross-section, for example semi-circular.

Figure 10:
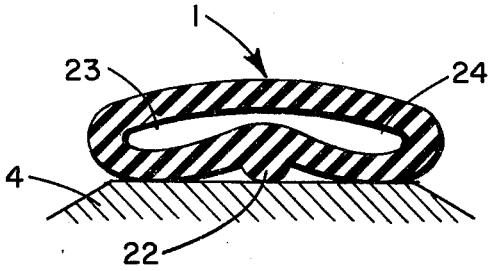
FIG. 10 is a cross-sectional view of the tube according to FIG. 9, flattened against a roller.

Periodically, one of the fingers or of the rollers 4 of the pump gradually flattens the peristaltic tube 1, the cross-section of which then assumes the shape shown in FIG. 10. Since the tube is produced from an elastic material, such as those mentioned earlier, it thereafter tends to resume the shape which it had at rest.

When the peristaltic tube 1 is flattened, the longitudinal ridge 22 causes the wall 20 of the tube 1 to bend on either side of the ridge 22, which prevents occlusion of the tube, by producing two passages 23 and 24 in the form of a spherical lune.

It is advantageous to orient the peristaltic tubes, according to the sixth embodiment of this invention, when they are arranged around the pressing devices of a peristaltic pump, that is to say it is advantageous if the ridge 22 is in contact with the fingers or with the rollers, as shown in FIG. 10.

Figure 11:
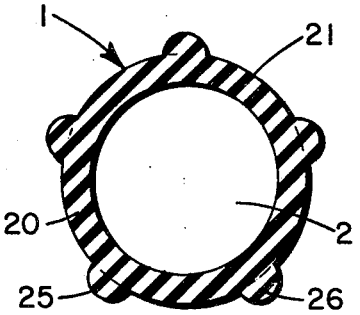
FIG. 11 is a cross-sectional view of a seventh embodiment of a peristaltic tube, at rest.
Figure 12:
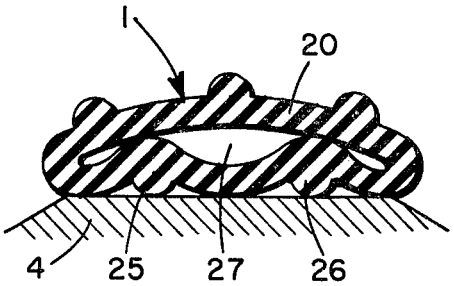
FIG. 12 is a cross-sectional view of the tube according to FIG. 11, flattened against a roller.

It is possible to produce peristaltic tubes comprising several external ridges. This seventh embodiment is shown in FIGS. 11 and 12. The peristaltic tube according to the present invention, represented in cross-section, at rest, in FIG. 11, and flattened in FIG. 12, is similar to the peristaltic tube described above. It possesses, on its external surface, five ridges such as, for example, 25 and 26, of substantially semicircular cross-section, and uniformly distributed. It is not necessary to orient such a peristaltic tube when it is placed in contact with the pressing devices. In fact, when the fingers or rollers 4 of the peristaltic pump gradually flatten the peristaltic tube, at least two ridges 25 and 26 come into contact with the roller 4, for example, and the wall 20 between them bends, producing a passage 27 which prevents occlusion of the peristaltic tube.

The cross-section of the ridges located on the external surfaces of the two embodiments of peristaltic tubes described above need not be semi-cylindrical. In fact, the ridge or ridges can also have, for example, a cross-section of substantially trapezoidal, triangular, square or rectangular shape. It is also possible to combine ridges of cross-sections of different shapes on the external surface of one and the same peristaltic tube.

The number of ridges is not critical but if the number is too high there is a risk of reducing the suppleness of the tube. It appears that five substantially parallel longitudinal external ridges are very suitable without, however, this number imposing a limitation.

It is not necessary for the ridges to be uniformly distributed over the external surface of a peristaltic tube. However, it is preferable that the portion of the external surface of the peristaltic tube in contact with the pressing devices should carry at least one ridge.

Figure 14A:
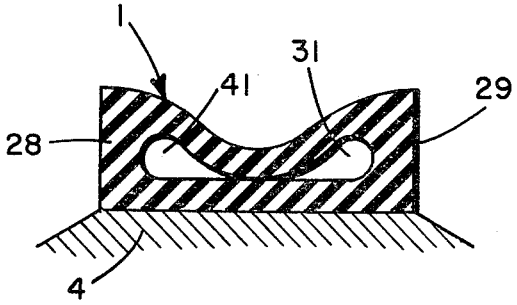
FIG. 14 is a cross-sectional view of the tube according to FIG. 13, flattened against a roller, two positions of the tube relative to the roller being shown, namely FIGS. 14A and 14B.
Figure 14B:
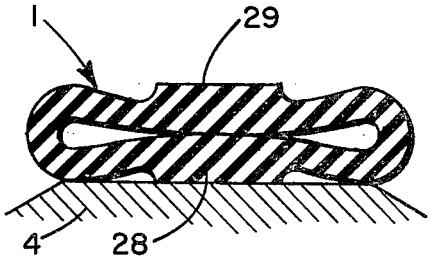

The peristaltic tube 1 according to an eighth embodiment of this invention possesses at least one longitudinal boss, generally along a generatrix of the tube. The tube represented in FIGS. 13 and 14A and B possesses two longitudinal bosses 28 and 29 which are, for example, diametrically opposite. FIGS. 14A and 14B illustrate, by way of example, two different relative positions of the roller and the peristaltic tube. According to FIG. 14A, the bosses 28 and 29 because of their width 30, and the resulting local greater thickness of the wall 20 of the tube 1, resist the occlusion of the tube when the latter is flattened by the rollers 4; two passages 31 and 41 are thus produced. According to FIG. 14B, the boss 28 plays a similar role to that of the ridge 22 of the tube according to FIG. 9.

Figure 15:
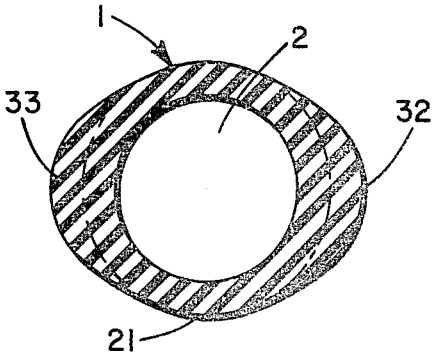
FIG. 15 is a cross-sectional view of a ninth embodiment of a peristaltic tube at rest.
Figure 16A:
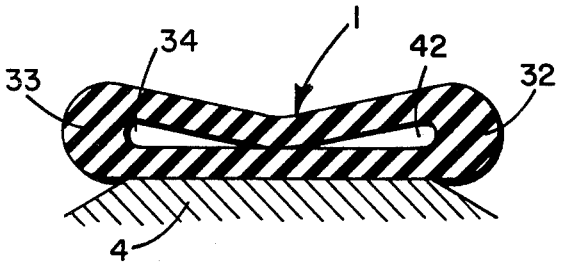
FIG. 16 is a cross-sectional view of the tube according to FIG. 15, flattened against a roller, two positions of the tube relative to the roller being shown, namely FIGS. 16A and 16B.
Figure 16B:
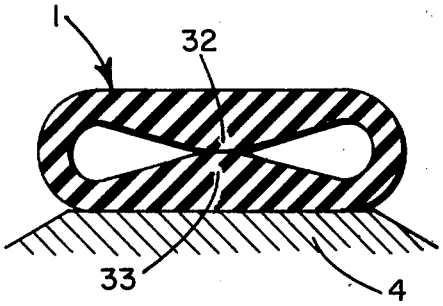
Figure 18B:
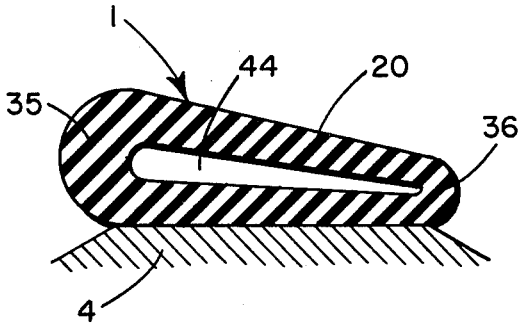

The ninth embodiment of the peristaltic tube 1, as shown in FIGS. 15 and 16A and B, exhibits, a substantially ellipsoidal external profile in cross-section. A greater thickness of the wall of the peristaltic tube corresponds to the major axis of the ellipse, at 32 and 33, this greater thickness being equivalent to longitudinal bosses of crescent-shaped cross-section, carried on the external surface 21 of the peristaltic tube 1. The greater thicknesses of the wall at 32 and 33 resist the occlusion of the tube when the latter is flattened by the roller 4, and two passages 34 and 42 are thus produced, in accordance with the arrangement shown in FIG. 16A. Similarly, according to the arrangement shown in FIG. 16B representing a 90° displacement of the tube 1, two passages are likewise produced.

Figure 18A:
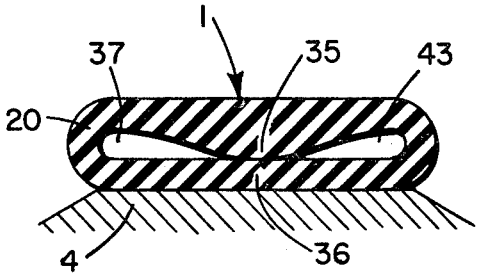
FIG. 18 is a cross-sectional view of the tube according to FIG. 17, flattened against a roller, three positions of the tube relative to the roller being shown, namely FIGS. 18A, 18B and 18C.
Figure 17:
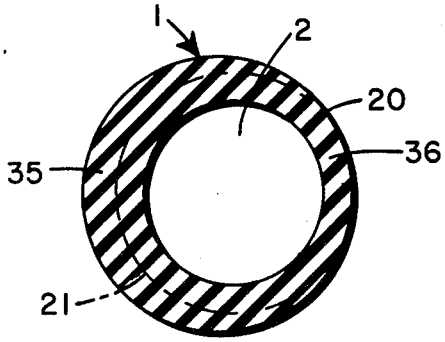
FIG. 17 is a cross-sectional view of a tenth embodiment of a peristaltic tube, at rest.
Figure 18C:
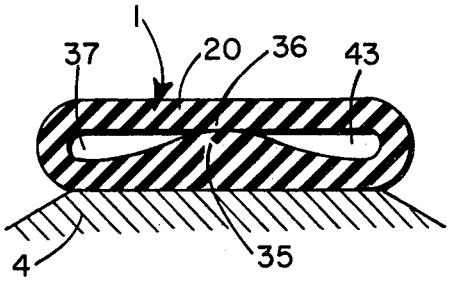

The peristaltic tube 1, of which a tenth embodiment is shown in FIGS. 17 and 18A, B and C, possesses a substantially cylindrical channel 2 and has a substantially circular external profile in cross-section. The cylindrical surfaces which define the wall of the tube are not coaxial so that the wall of the tube is not of constant thickness, and so has a thick zone 35 and a thin zone 36.

The means which prevent the occlusion of such a peristaltic tube in this case consist of a boss, of crescent-shaped cross-section, contained between the external surface 21 of the tube (this surface is, in this embodiment, virtually completely imaginary) and a non-coaxial cylindrical surface which externally defines the said tube. The thick zone 35 of the wall 20 resists the occlusion of the tube when the latter is flattened by the roller 4. According to the positions of the roller and the tube shown in FIGS. 18A and C, two passages 37 and 43 are produced. According to the position shown in FIGS. 18B, one passage 44 is produced. These represent successively 90° displacements of the tube 1.

Figure 19:
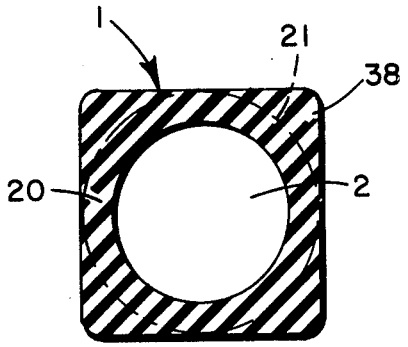
FIG. 19 is a cross-sectional view of an eleventh embodiment of a peristaltic tube, at rest.
Figure 20:
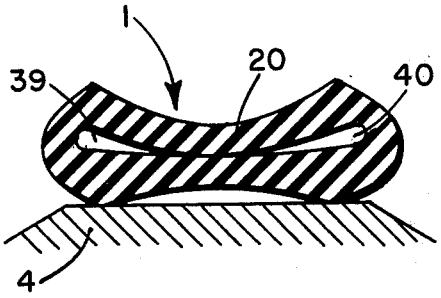
FIG. 20 is a cross-sectional view of the tube according to FIG. 19, flattened against a roller.

The peristaltic tube 1, of which an eleventh embodiment is shown in FIGS. 19 and 20, comprises a substantially cylindrical channel 2 and a wall 20 which in cross-section exhibits a polygonal external profile, which in the present case is substantially square. The external surface 21 is, in this embodiment also, virtually completely imaginary and the bosses have a cross-section in the form of a curvilinear triangle. Thus, the wall 20 of the tube 1 is not of constant thickness and is in fact thicker in the zones of the edges of the prism, such as 38. These thicker zones resist the occlusion of the tube when the latter is flattened by the roller 4, and two passages 39 and 40, for example, are produced as shown in FIG. 20.

The peristaltic tube can possess three longitudinal bosses of which the cross-sectional shape is that of a curvilinear traingle, in which case the tube has a substantially triangular external profile in cross-section.

Figure 21:
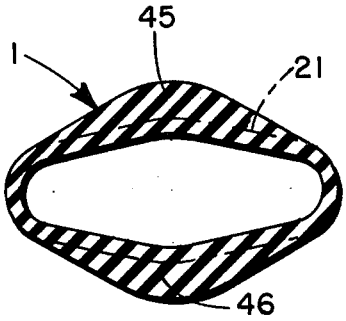
FIG. 21 is a cross-sectional view of a twelfth embodiment of a peristaltic tube, at rest.
Figure 22:
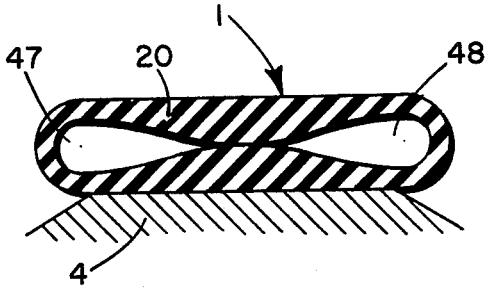
FIG. 22 is a cross-sectional view of the tube according to FIG. 21, flattened against a roller.

The peristaltic tube 1, of which a twelfth embodiment is shown in FIGS. 21 and 22, comprises a channel 2 of substantially elliptical cross-section and a wall 20 which in cross-section exhibits an external profile which is also substantially elliptical and is such that the wall 20 is of greater thickness along the minor axis than along the major axis of the ellipses. Thus, the wall of the peristaltic tube is not of constant thickness and the thicker zones at 45 and 46 are equivalent to bosses located on the external surface 21, which in this case is largely imaginary. The tube 1 flattened by the roller 4 is not occlusive and two passages are thus produced at 47 and 48.

For reasons of ease of manufacture, the means which limit the occlusion of the peristaltic tube and are located on its external surface advantageously extend over the entire length of the peristaltic tube, and the peristaltic tube can thus easily be obtained, for example, by extrusion. If desired, however, these means can extend solely over the part of the peristaltic tube which is subjected to the action of the fingers or rollers of the pump.

The peristaltic pumps according to the invention, provided with peristaltic tubes of the type in which the means which limit their occlusion are located on the external surface of the wall of the peristaltic tube, as described above, have an internal cylindrical surface with a directrix in the shape of a closed curve without a point of inflexion, for example — and most frequently — a circular curve. It is thus easy to connect such a pump to the fluid channels upstream and downstream by means of couplings of which the cylindrical external surface has a directrix in the shape of a closed curve without a point of inflexion, for example — and most frequently — a circular curve. It is also easily possible to use couplings which carry, on their external surface, one or more annular beads located in one or more planes which are substantially perpendicular to the axis of the coupling.

Without going beyond the scope of the invention, it is also possible to combine with one another two or more embodiments as described above, it being understood, of course, that these have only been described by way of examples and do not imply any limitation on the invention.

The pump according to this invention has numerous advantages. Firstly, it offers increased safety of operation compared to pumps of known types. It effectively retains the air contained in a liquid, regardless of the tension of the tube, the pressure exerted by the rollers, or the speed of movement of the rollers. It thus makes it possible with complete safety to dispense with the use of a bubble-detecting device. Since the delivery of the pump decreases gradually in accordance with the increase in volume of air retained, it suffices to purge the system periodically, if necessary.

Furthermore, the convenience of use is greatly improved because the tension of the tube, the pressure of the rollers and/or their drive speed may be regulated without concerning oneself with the retention of the air.

Furthermore, according to a certain embodiment, as has been seen, the local thinning of the tube makes it possible to reduce the stresses on the tube and increase its life and safety of operation, whilst according to other embodiments there is the advantage of making it possible to obtain satisfactory leakproofness between the ends of the peristaltic tube and the cylindrical couplings without requiring the use of packing or leakproofing elements.

The manufacture of the pump according to the present invention is very simple because it generally amounts only to the manufacture of a suitable peristaltic tube. In fact, and this is a considerable advantage, the peristaltic tubes according to this invention can be used to equip mechanical units for peristaltic pumps of all known types. They can be used to equip, for example, pumps with fingers or rollers, which may or may not rotate, which may compress the hose or stretch the hose, which are equipped with one tube or with several parallel tubes, with tube guide devices, and so on, the tubes generally being in the position of an inverted U.

The pump according to this invention makes it possible to satisfy a great diversity of applications. Thus, in the medical field, it is advantageous for use in extracorporal blood circuits, especially including artificial kidneys or blood oxygenators.

What is claimed is:

1. In a peristaltic pump assembly, the improvement which comprises a peristaltic tube of flexible material having an inlet end and an outlet end, the wall of the tube being provided with at least one wall surface irregularity rendering the cross-section of the wall of the tube noncircular cylindrical in at least that region on which flat roller tube flattening elements of the peristaltic pump act in flattening the tube against an arcuate backing element to exercise a peristaltic pumping action, the irregularity leading to at least one arcuate reservoir being defined by the inside wall of the tube when the tube is flattened in said region, within which arcuate reservoir gas can collect while liquid is being peristaltically pumped through the tube.

2. A peristaltic pump aseembly according to claim 1, in which the wall surface irregularity comprises at least one longitudinal groove in the internal wall surface of the tube.

3. A peristaltic pump assembly according to claim 2, in which at least two identical parallel grooves are provided in diametrically opposed relationship, the wall of the tube being of reduced thickness along such grooves.

4. A peristaltic pump assembly according to claim 1, in which the wall surface irregularity comprises at least one longitudinal ridge located on the internal wall surface of the tube.

5. A peristaltic pump assembly according to claim 1, in which a strand of material is located inside the tube and which is pressed against the inside wall of the tube by the tube flattening elements during peristaltic pumping to thereby provide the wall surface irregularity which is then along the internal wall surface of the tube.

6. A peristaltic pump assembly according to claim 5, in which the strand of material possesses rigidity and is in the shape of an arc of a circle so that the peristaltic tube is maintained in similar shape by said strand.

7. A peristaltic pump assembly according to claim 5, in which the strand of material is flexible and is firmly attached to the inside wall of the tube at least at a point situated towards the inlet end thereof.

8. A peristaltic pump assembly according to claim 1, in which the wall surface irregularity comprises at least one longitudinal ridge located on the external wall surface of the tube.

9. A peristaltic pump assembly according to claim 1, in which the wall surface irregularity comprises longitudinal bosses having crescent-shaped cross-sections, said bosses being diametrically opposed on the outer surface of the tube such that the external cross-sectional profile of the peristaltic tube is substantially eliptical.

10. A peristaltic pump assembly according to claim 1, in which the wall surface irregularity comprises at least three longitudinal bosses having a cross-sectional shape in the form of a curvilinear triangle, said bosses being arranged on the outer surface of the tube such that the external cross-sectional profile of the peristaltic tube is substantially polygonal.

11. A peristaltic pump assembly according to claim 1, in which the ratio of the cross-sectional area of the open fluid passage defined by the inside wall surface of the peristaltic tube when this is flattened to the cross-sectional area defined by the inside wall surface of the peristaltic tube when the tube is not flattened is between 1/10 and 1/10,000.

12. A peristaltic pump assembly according to claim 1, in which the wall surface irregularity comprises a wedge-shaped irregularity along the inside surface of a tube formed by a longitudinal joint joining together longitudinal marginal regions on one face of a rectangular sheet of elastomer.

13. A peristaltic tube for use in a peristaltic pump assembly, comprising a tube of flexible material having an inlet end and an outlet end, the inside wall surface of the tube being circular cylindrical and the outside wall surface of the tube also being circular cylindrical with its axis eccentric to the axis of the inside wall surface whereby the wall of tube comprises a longitudinal crescent-shaped cross-sectional thickening of the tube wall in at least the region on which tube flattening elements of the peristaltic pump act in flattening the tube to exercise a peristaltic pumping action, the thickening of the tube wall leading to at least one open fluid passage being defined by the inside wall of the tube when the tube is flattened in said region by said flattening elements.

* * * * *